US008586851B2

(12) United States Patent
Matsuoka et al.

(10) Patent No.: US 8,586,851 B2
(45) Date of Patent: Nov. 19, 2013

(54) VIBRATION SENSOR FOR MUSICAL INSTRUMENT AND PICKUP SADDLE

(75) Inventors: Junya Matsuoka, Hamamatsu (JP); Atsuo Hattori, Iwata (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 13/425,652

(22) Filed: Mar. 21, 2012

(65) Prior Publication Data

US 2012/0240752 A1 Sep. 27, 2012

(30) Foreign Application Priority Data

Mar. 24, 2011 (JP) ..... 2011-065215

(51) Int. Cl.
*G10H 3/18* (2006.01)

(52) U.S. Cl.
USPC ..... 84/731

(58) Field of Classification Search
USPC ..... 84/731, 730
See application file for complete search history.

(56) References Cited

U.S. PATENT DOCUMENTS

| | | | | |
|---|---|---|---|---|
| 5,123,325 | A * | 6/1992 | Turner | 84/731 |
| 5,670,733 | A * | 9/1997 | Fishman | 84/731 |
| 5,900,572 | A * | 5/1999 | Aaroe | 84/731 |
| 6,023,019 | A | 2/2000 | Baggs | |
| 6,078,006 | A * | 6/2000 | Raisanen et al. | 84/733 |
| 6,248,947 | B1 * | 6/2001 | Enke | 84/730 |
| 6,677,514 | B2 * | 1/2004 | Fishman | 84/730 |
| 6,916,979 | B2 * | 7/2005 | Raisanen | 84/731 |
| 7,157,640 | B2 * | 1/2007 | Baggs | 84/731 |
| 7,227,967 | B2 * | 6/2007 | Naniki | 381/190 |
| 7,982,125 | B2 * | 7/2011 | Takabayashi et al. | 84/731 |
| 2004/0105560 | A1 * | 6/2004 | Naniki | 381/190 |
| 2010/0307324 | A1 * | 12/2010 | Takabayashi | 84/731 |

FOREIGN PATENT DOCUMENTS

| | | | |
|---|---|---|---|
| JP | 61-196298 | U | 12/1986 |
| JP | 1-126692 | U | 8/1989 |
| WO | WO-98/02869 | A1 | 1/1998 |
| WO | WO-2008/117483 | A1 | 10/2008 |

OTHER PUBLICATIONS

European Search Report issued for EP 12 00 1939, dated Jun. 28, 2012.

* cited by examiner

*Primary Examiner* — Jeffrey Donels
(74) *Attorney, Agent, or Firm* — Dickstein Shapiro LLP

(57) ABSTRACT

A vibration sensor for a musical instrument includes a substrate, a first electrode film that is formed on the substrate, a piezoelectric film that is formed on the first electrode film, a second electrode film that is formed on the piezoelectric film, an insulating film that is formed on the second electrode film, and a shield film that is formed on the insulating film, the shield film being made of a conductive material, electrically connected to the first electrode film and insulated from the second electrode film by the insulating film.

13 Claims, 12 Drawing Sheets

VIBRATION SENSOR FOR MUSICAL INSTRUMENT AND PICKUP SADDLE

BACKGROUND OF THE INVENTION

1. Field of the Invention

The present invention relates to a vibration sensor for a musical instrument and a pickup saddle.

Priority is claimed on Japanese Patent Application No. 2011-65215, filed Mar. 24, 2011, the content of which is incorporated herein by reference.

2. Description of Related Art

In the past, a pickup saddle was known which includes a vibration sensor converting a string vibration of a guitar or the like into an electrical signal and which supports a string (for example, see PCT International Publication No. WO2008/117483A1). Compared with a case where a vibration sensor is interposed between a saddle and an instrument body, it is possible to stably convert a string vibration into an electrical signal without damaging the appearance of a musical instrument by building the vibration sensor in the saddle. The vibration sensor of the pickup saddle described in PCT International Publication No. WO2008/117483A1 is bonded to an outer shell member constituting the profile of the pickup saddle with an adhesive in a state where a piezoelectric element is interposed between two electrode plates and the resultant is wound with a thread and temporarily fixed. PCT International Publication No. WO2008/117483A1 discloses a technique of bonding or applying an insulating shield material to the surface of the vibration sensor before the vibration sensor is bonded to the outer shell member so as to shield the vibration sensor from electromagnetic waves which causes noise in the output of the vibration sensor.

However, as described in PCT International Publication No. WO2008/117483A1, when the vibration sensor is bonded to the outer shell member in the state where the piezoelectric element and the electrode plates are wound with a thread and temporarily fixed, there is a high possibility that the electrical connection between the piezoelectric element and the electrode plates may be unstable. Particularly, the possibility that the contact state between the piezoelectric element and the electrode plates can vary due to a large force acting during musical performance is very high. When a conductive material such as a conductive adhesive is interposed between the piezoelectric element and the electrode plates so as to prevent the variation in contact state, the flowing conductive material may short-circuit two electrode plates with the piezoelectric element interposed therebetween.

As described in PCT International Publication No. WO2008/117483A1, the manufacturing method including the fixing of the electrode plates and the bonding and application of an insulating shield material includes many processes requiring manual work and thus raises the manufacturing cost thereof.

SUMMARY OF THE INVENTION

An advantage of some aspects of the invention is that it provides a vibration sensor for a musical instrument and a pickup saddle which have stable output characteristics and high durability.

According to an aspect of the invention, there is provided a vibration sensor for a musical instrument, including: a substrate; a first electrode film that is formed on the substrate; a piezoelectric film that is formed on the first electrode film; a second electrode film that is formed on the piezoelectric film;

an insulating film that is formed on the second electrode film; and a shield film that is formed on the insulating film, the shield film being made of a conductive material, electrically connected to the first electrode film and insulated from the second electrode film by the insulating film.

In the specification, when an upper layer is formed on a lower layer through the use of the thin film forming techniques, it may be stated that the upper layer is "directly coupled to" the lower layer.

Since the piezoelectric film is directly coupled to two electrode films, the bonding strength between the piezoelectric film and the electrode films is large. Accordingly, the contact state between the piezoelectric film and the electrode films does not easily vary, even when a large force acts on the piezoelectric film and the electrodes during the musical performance. Therefore, it is possible to implement a sensor for a musical instrument which have stable output characteristics and high durability. Since the sensor for a musical instrument is manufactured through the use of a thin film forming technique, the positional precision of each layer is high and the sensor can be manufactured with a small thickness and a small size at a low cost. The insulating film and the shield film can be stacked on the second electrode film through the use of a thin film forming technique. That is, according to the aspect of the invention, it is possible to enhance a S/N ratio and durability and to suppress the manufacturing cost.

The vibration sensor for a musical instrument according to the aspect of the invention may further include an insulating film that is directly coupled to the second electrode film to overlap with the second electrode film and a shield film that is directly coupled to the insulating film, the piezoelectric film, and the first electrode film to overlap with the insulating film, that is formed of a conductive material, and that is insulated from the second electrode film with the insulating film. An end face of the piezoelectric film directly coupled to the shield film may be sloped. Specifically, the end face of the piezoelectric film may be sloped so that the piezoelectric film is widened toward the substrate. At least part of the end face of the first electrode film may be located inward from the sloped end face of the piezoelectric film, and the second electrode film may reach the substrate along the sloped end face of the piezoelectric film. By employing this configuration, since the end face of the piezoelectric film is sloped, the degradation in step coverage of the shield film is not caused which may occur when the end face is vertical, and it is thus possible to enhance the bonding strength between the shield film and the underlying film and to prevent the disconnection of the shield film.

In the vibration sensor for a musical instrument according to the aspect of the invention, a film formed of a magnetic material may be formed on the rear surface of the substrate. By employing this configuration, it is possible to enhance the shield effect of magnetic noise. The rear surface of the substrate means a surface corresponding to the backside of the surface on which the first electrode film, the piezoelectric film, the second electrode film, the insulating film, and the shield film are stacked. The first electrode film, the second electrode film, or at least part of the shield film may be formed of a magnetic material. By employing this configuration, it is possible to further enhance the shield effect of magnetic noise.

The substrate may be formed of Si, Si compound, zirconia, glass, or glass ceramic. Since zirconia has high toughness, the durability of the vibration sensor for a musical instrument can be further enhanced and it is thus easy to fix the vibration sensor for a musical instrument to a vibration member such as a saddle in a state where the vibration sensor is curved. In addition, zirconia is high in heat resistance and bending strength. Accordingly, it is possible to endure high-temperature heat in the manufacturing process thereof and to endure warpage due to the difference in thermal expansion coefficients between the stacked materials. Even when the substrate is formed thin, the substrate is not easily cracked in the manufacturing process. Accordingly, it is possible to implement a vibration sensor for a musical instrument and to enlarge the degree of freedom in the fixing position and fixing direction relative to the saddle. The zirconia may be partially-stabilized zirconia. The partially-stabilized zirconia includes, for example, yttria, thereby enhancing the toughness and the heat resistance.

According to another aspect of the invention, there is provided a pickup saddle including a saddle that supports a string and the vibration sensor for a musical instrument that is fixed to the saddle. According to this aspect, it is possible to implement a pickup saddle in which the vibration sensor for a musical instrument is inconspicuous and which can achieve stable output characteristics. The location to which the vibration sensor for a musical instrument is fixed may be the inside of the saddle or the outside thereof.

The vibration sensor for a musical instrument may be fixed to the saddle in a state where the vibration sensor is curved. By employing this configuration, the vibration sensor for a musical instrument can be fixed to a region having any shape. Accordingly, it is possible to achieve excellent output characteristics or to fix the vibration sensor for a musical instrument to the saddle in an inconspicuous region.

The pickup saddle may further include a sensor receiving section that is formed in the saddle and that receives the vibration sensor for a musical instrument and a filler that fills a region in the sensor receiving section other than the vibration sensor for a musical instrument. The vibration sensor for a musical instrument may be received in the sensor receiving section in a state where the substrate is curved. For example, the top surface of the saddle supporting the string may be a curved surface and the vibration sensor for a musical instrument may be fixed to the top surface of the saddle. By employing this configuration, since the attenuation until string vibration propagates to the vibration sensor for a musical instrument is reduced, it is possible to enhance the sensitivity and to raise the response speed.

DETAILED DESCRIPTION OF THE INVENTION

Figure 1A:
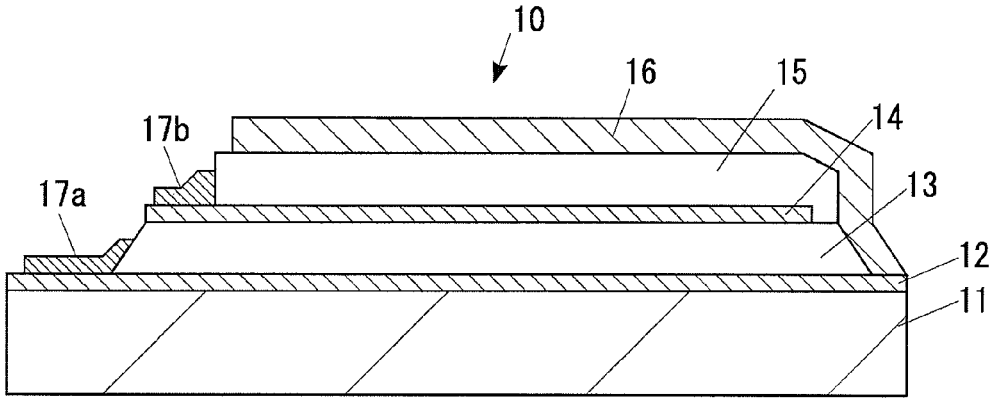
FIG. 1A is a cross-sectional view illustrating a vibration sensor for a musical instrument of a first embodiment according to the present invention.

Hereinafter, embodiments of the invention will be described with reference to the accompanying drawings. In the drawings, like elements are referenced by like reference signs and descriptions thereof will not be repeated.

Vibration Sensor for Musical Instrument

Figure 1B:
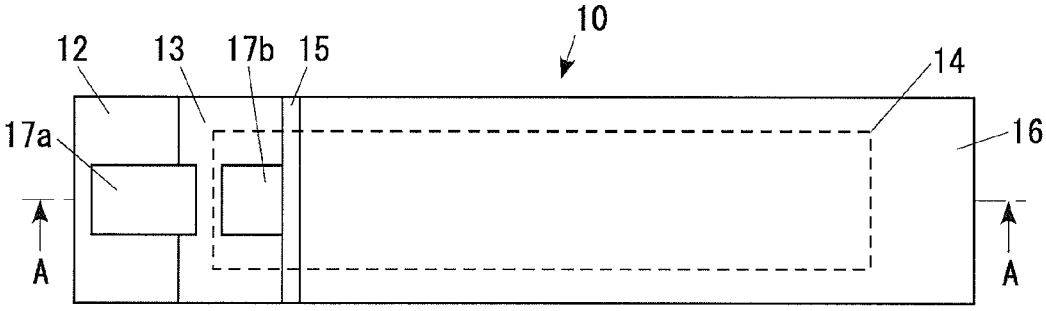
FIG. 1B is a plan view of the vibration sensor for a musical instrument shown in FIG. 1A.
Figure 9:
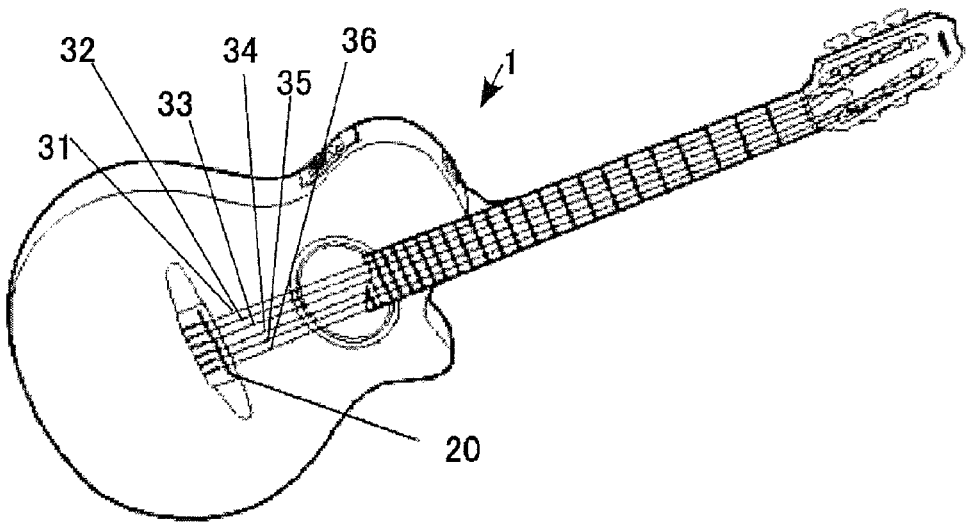
FIG. 9 is a perspective view illustrating a guitar according to an embodiment of the present invention.

FIGS. 1A and 1B show a vibration sensor for a musical instrument of a first embodiment according to the present invention. FIG. 1A is a cross-sectional view showing the vibration sensor taken along line A-A of FIG. 1B. The vibration sensor for a musical instrument 10 is, for example, a sensor for detecting string vibration of a guitar 1 shown in FIG. 9. The vibration sensor for a musical instrument 10 is a laminated structure manufactured through the use of a thin film forming technique such as a screen printing technique or a semiconductor manufacturing technique. Accordingly, a substrate 11, a first electrode film 12, a piezoelectric film 13, a second electrode film 14, an insulating film 15, and a shield film 16 constituting the vibration sensor for a musical instrument 10 are incorporated into a body by direction bonding without using an adhesive or the like. The outer size of the vibration sensor for a musical instrument 10 can be arbitrarily set depending on the shape of a saddle 20. For example, the thickness of the vibration sensor for a musical instrument 10 detecting vibration of six strings of a guitar can be 0.1 mm to 3 mm, the width of the vibration sensor for a musical instrument 10 can be 1 mm to 8 mm, and the length of the vibration sensor for a musical instrument 10 can be 3 mm to 80 mm.

The substrate 11 is, for example, a plate-like member with a thickness of about 0.2 mm. Durability for enduring a load acting during the performance of the musical instrument and heat resistance for enduring a thermal load in the manufacturing process such as heat treatment on the piezoelectric film 13 are required for the substrate 11. For example, the substrate 11 can be formed of silicon, glass, glass ceramic, or metal. Particularly, zirconia ($ZrO_2$), for example, partially-stabilized zirconia containing yttria, can be suitable used as the material of the substrate 11. Since zirconia has high heat resistance, it can satisfactorily endure the heat treatment on the piezoelectric film 13. When the substrate 11 is formed of zirconia, the toughness of the substrate 11 is high, thereby enhancing the durability and using the vibration sensor for a musical instrument 10 in a state where the vibration sensor is curved.

The first electrode film 12 overlapping with the top surface of the substrate 11 is, for example, a conductive film with a thickness of 2 μm. The first electrode film 12 is formed of metal such as platinum (Pt). The first electrode film 12 is formed through the use of a thin film forming technique such as a screen printing method and a sputtering method. Accordingly, the first electrode film 12 is directly coupled to the top surface of the substrate 11. An electrode pad 17*a* for electrical connection to a conductor wire (ground line) of a ground potential is formed in an end portion of the top surface of the first electrode film 12. The electrode pad 17*a* is formed of, for example, aluminum (Al). The conductor wire may be directly connected to the first electrode film 12 with the first electrode film 12 as an electrode pad, without forming an electrode pad on the first electrode film 12.

The piezoelectric film 13 overlapping with the top surface of the first electrode film 12 is a film formed of, for example, a piezoelectric material with a thickness of 35 μm. The piezoelectric film 13 is formed of a piezoelectric material such as PZT (Piezoelectric Zirconate Titanate). The piezoelectric film 13 is formed on the surface of the first electrode film 12 through the use of a thin film forming technique such as a sol-gel method, a sputtering method, a CVD method, and a screen printing method. Accordingly, the piezoelectric film 13 is directly coupled to the top surface of the first electrode film 12. By forming the piezoelectric film 13 through the use of the screen printing method, the end face of the piezoelectric film 13 can be sloped. When the end face of the piezoelectric film 13 is sloped, the step coverage of the layer formed with the end face of the piezoelectric film 13 and the top surface of the first electrode film 12 as an underlying surface is improved, thereby enhancing the bonding strength.

The second electrode film 14 overlapping with the top surface of the piezoelectric film 13 is, for example, a conductive film with a thickness of about 2 μm. The second electrode film 14 is formed with an area equal to that of the top surface of the piezoelectric film 13 or smaller than that of the top surface of the piezoelectric film 13. The second electrode film 14 is formed of metal such as gold (Au) and aluminum (Al). The second electrode film 14 is formed through the use of a thin film forming technique such as a screen printing method and a sputtering method. Accordingly, the second electrode film 14 is directly coupled to the top surface of the piezoelectric film 13. An electrode pad 17*b* for electrical connection to a conductor wire is formed in an end portion on the surface of the second electrode film 14. The electrode pad 17*b* is formed of, for example, aluminum (Al). A conductor line may be directly connected to the second electrode film 14 with the second electrode film 14 as an electrode pad, without forming an electrode pad on the second electrode film 14.

The insulating film 15 overlapping with the top surface of the second electrode film 14 covers the entire top surface of the second electrode film 14 except for the end portion on which the electrode pad 17*b* is formed. The insulating film 15 is formed of, for example, an insulating film such as polyimide with a thickness of 40 μm. The insulating film 15 is formed through the use of a thin film forming technique such as a screen printing method, a spin coating method, a laminating method, a CVD method, a sputtering method, a vapor deposition method, and a vapor-deposition and polymerization method. Accordingly, the insulating film 15 is directly coupled to the top surface of the second electrode film 14.

The shield film 16 overlapping with the top surface of the insulating film 15 is formed of, for example, a conductive material such as aluminum with a thickness of 2 μm. The shield film 16 covers most of the top surface of the vibration sensor for a musical instrument 10 and is coupled to the grounded first electrode film 12. Accordingly, the shield film 16 serves as an electromagnetic shield along with the grounded first electrode film 12. The shield film 16 is formed through the use of a thin film forming technique such as a sputtering method, a CVD method, a screen printing method, and a plating method. Accordingly, the shield film 16 is directly coupled to the insulating film 15, the piezoelectric film 13, and the first electrode film 12. In FIG. 1A, an end portion of the insulating film 15 is formed at the same position as the end portion of the piezoelectric film 13, but is not limited to this position. The end portion of the insulating film 15 may retreat from the end portion of the piezoelectric film 13.

Figure 1C:
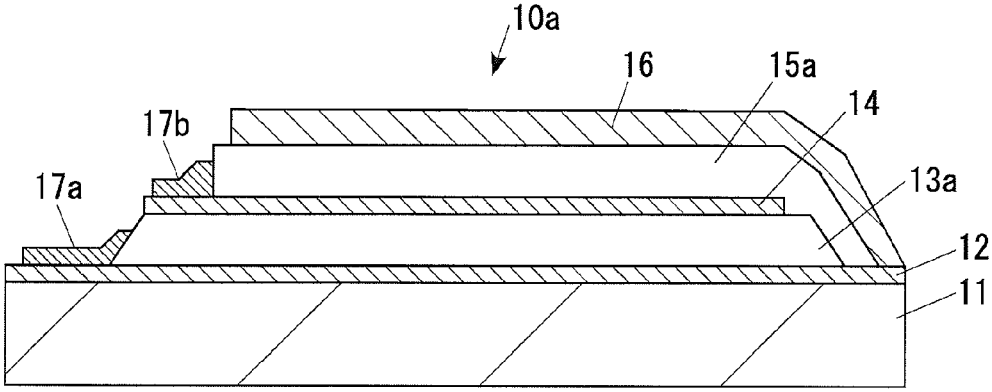
FIG. 1C is a cross-sectional view illustrating a modification of the vibration sensor for a musical instrument shown in FIG. 1A.

The end face of the piezoelectric film 13 may be covered with an insulating film 15*a* as in a vibration sensor for a musical instrument 10*a* shown in FIG. 1C.

As described above, since the layers on the substrate 11 constituting the vibration sensor for a musical instrument 10 are formed through the use of the thin film forming techniques, the bonding strength between the layers directly coupled to each other is high (in the specification, when an upper layer is formed on a lower layer through the use of the thin film forming techniques, it is stated that the upper layer is "directly coupled to" the lower layer). Accordingly, even when a large load acts thereon during the musical performance, the separation of the piezoelectric film 13 and the first electrode film 12 from each other or the separation of the piezoelectric film 13 and the second electrode film 14 from each other does not easily occur. Therefore, it is possible to prevent the separation of the electrode in the vibration sensor for a musical instrument 10 or the short circuit between the electrodes. By forming the shield film 16 into a body through the use of the thin film forming technique, it is possible to enhance the S/N ratio and to suppress the manufacturing cost. As a result, it is possible to implement a vibration sensor for a musical instrument 10 with high reliability which can endure use in a concert hall or the like having a large amount of noise.

Fine patterns with high size precision and high positioning precision may be formed on each layer on the substrate 11 through the use of a photolithography technique. Accordingly, it is easy to reduce the size of the vibration sensor for a musical instrument 10. As a result, it is possible to easily implement a vibration sensor for a musical instrument 10 which is inconspicuous.

Figure 2A:
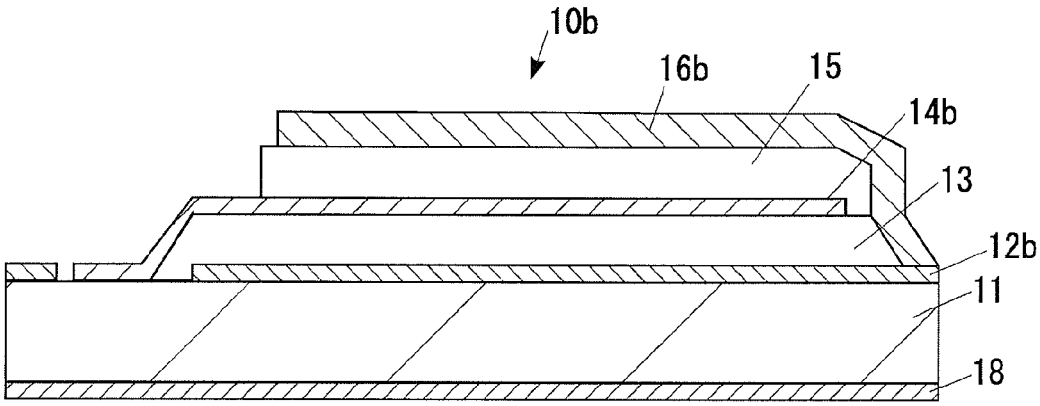
FIGS. 2A and 2B are a cross-sectional view and a plan view, respectively, illustrating a vibration sensor for a musical instrument of a second embodiment according to the present invention.

A vibration sensor for a musical instrument of a second embodiment according to the invention will be described below with reference to FIGS. 2A and 2B. FIG. 2A is a cross-sectional view taken along line A-A of FIG. 2B. In the vibration sensor for a musical instrument 10*b* of the second embodiment, a film formed of a magnetic material is formed on the rear surface of the substrate so as to enhance a magnetic shield effect from noise based on a magnetic field.

Specifically, in the vibration sensor for a musical instrument 10*b* shown in FIG. 2A, a film is formed on the rear surface of the substrate 11 out of magnetic metal such as iron (Fe), nickel (Ni), and cobalt (Co), alloy thereof, or alloy containing magnetic metal, whereby a magnetic shield film 18 is formed. When a ground line is connected to the magnetic shield film 18, it is possible to prevent electromagnetic noise. In order to prevent only the electromagnetic noise, the magnetic shield film 18 may be formed of nonmagnetic metal. By forming a first electrode film 12*b*, a second electrode film 14*b*, or a shield film 16*b* out of a magnetic material, it is possible to achieve a higher magnetic shield effect. Particularly, a soft magnetic material such as permalloy has a high magnetic shield effect, which is preferable. The shield film may include two layers of a nonmagnetic metal film of copper (Cu) or the like and a magnetic film of permalloy or the like. It is possible to prevent the magnetic noise by the use of the copper film and to achieve the magnetic shield effect by the use of the permalloy film.

Figure 2B:
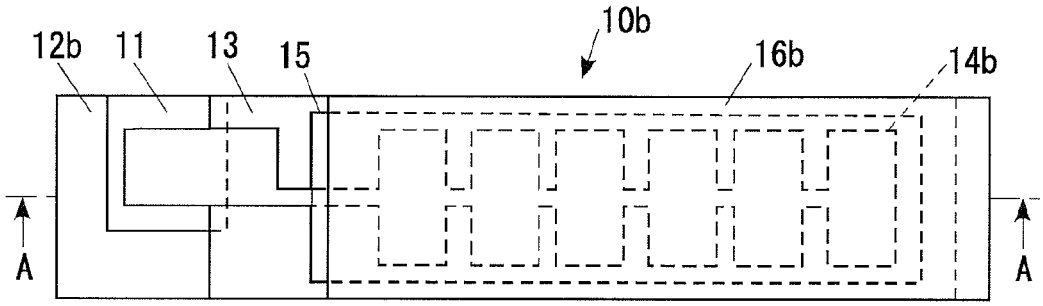

As shown in FIGS. 2A and 2B, in the vibration sensor for a musical instrument 10*b*, the pattern of the second electrode film 14*b* extends to the substrate 11 along the end face of the piezoelectric film 13. In this case, at least part of the end face of the first electrode film 12*b* needs to be located inward from the end face of the piezoelectric film 13 along which the second electrode film 14*b* extends so as not to bring the second electrode film 14*b* into direct contact with the first electrode film 12*b*. In this case, by sloping the end face of the piezoelectric film 13 so as to widen the piezoelectric film toward the substrate 11, it is possible to prevent the disconnection of the second electrode film 14*b*.

In the vibration sensor for a musical instrument 10*b*, since the patterns of the layer on the substrate 11 can be precisely controlled by the use of a thin film forming technique such as a screen printing technique and a photolithography technique, the second electrode film 14*b* is divided into multiple areas depending on the arrangement of the strings, as shown in FIG. 2B. Signals can be individually extracted from the divided areas. In the vibration sensor for a musical instrument 10*b*, conductor wires are directly connected to the first electrode film 12*b* and the second electrode film 14*b* as an electrode pad, without particularly forming an electrode pad, as shown in FIGS. 2A and 2B. The piezoelectric film and the second electrode film may be divided into multiple areas depending on the arrangement of the strings and a damping material may be interposed between the neighboring areas of the piezoelectric film.

Pickup Saddle

Figure 3A:
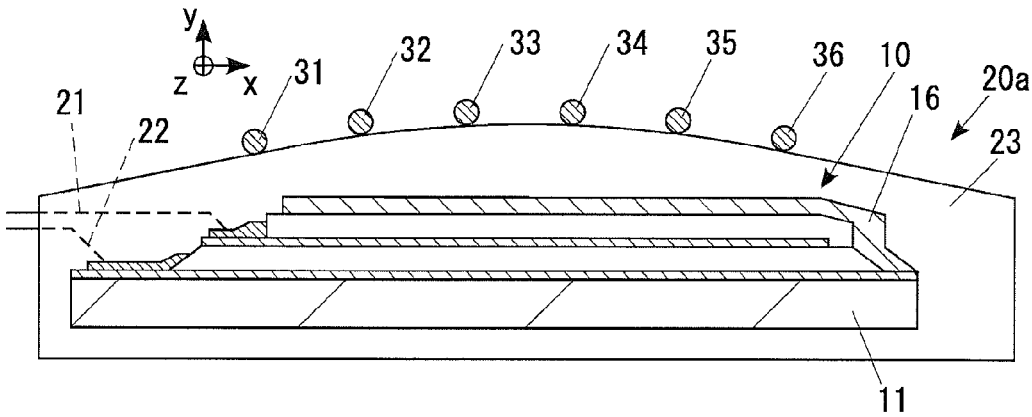
FIGS. 3A and 3B are a cross-sectional view and a plan view, respectively, illustrating a pickup saddle of the first embodiment according to the present invention.

FIGS. 3A and 3B and FIGS. 4 and 5 show pickup saddles 20*a*, 20*b*, and 20*c* of the first, second, and third embodiments using the above-mentioned vibration sensor for a musical instrument 10. FIG. 3A is a cross-sectional view taken along line A-A of FIG. 3B. The pickup saddles 20*a*, 20*b*, and 20*c* serve as a saddle 20 supporting strings 31 to 36 of a stringed instrument such as the guitar 1 shown in FIG. 9 and also serve as a pickup converting the vibrations of the strings 31 to 36 into electrical signals. The top surfaces of saddle bodies 23, 24, and 25 supporting multiple strings 31 to 36 have a shape including a curved surface. Conductor wires 21 and 22 connected to the electrode pads 17*a* and 17*b* of the vibration sensor for a musical instrument 10 are drawn to the outside of the saddle body 23 and are connected to an amplifier or the like.

The conductor wires 21 and 22 are drawn from the side surface of the saddle body 23. Alternatively, the conductor wires 21 and 22 may be drawn from the bottom surface of the saddle body 23 to shade the wires 21 and 22 with the saddle body 23 from view.

Figure 3B:
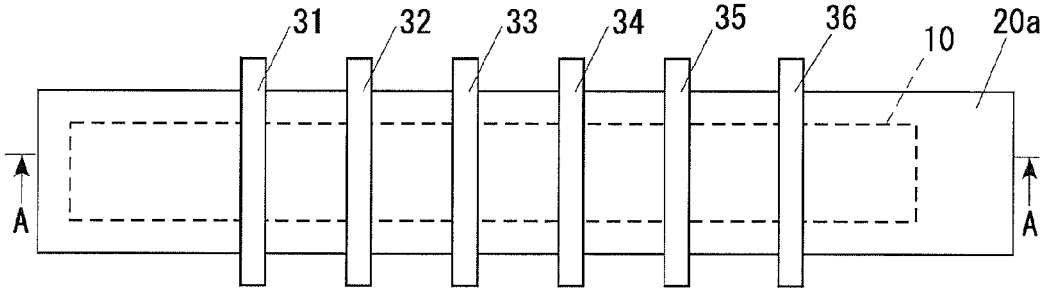
Figure 4:
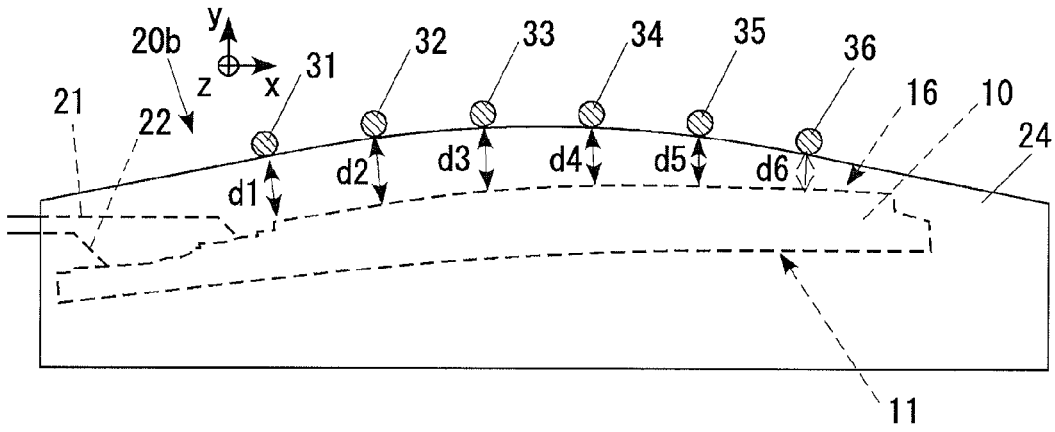
FIG. 4 is a side view illustrating a pickup saddle of the second embodiment according to the present invention.

Referring to FIGS. 3A and 3B and FIG. 4, the pickup saddles 20*a* and 20*b* of the first and second embodiments include saddle bodies 23 and 24 receiving the vibration sensor for a musical instrument 10 therein. By receiving the vibration sensor for a musical instrument 10 in the saddle bodies 23 and 24, it is possible to make the vibration sensor for a musical instrument 10 inconspicuous. A cavity for receiving the vibration sensor for a musical instrument 10 is formed in each of the saddle body 23 and 24. The vibration sensor for a musical instrument 10 is fixed to the saddle bodies 23 and 24 with a posture in which the shield film 16 is located close to the top surfaces of the saddle bodies 23 and 24 and the substrate 11 is located close to the bottom surfaces of the saddle bodies 23 and 24. When the vibration sensor for a musical instrument 10 is fixed with this posture, the first electrode film 12 and the second electrode film 14 face each other in the y direction and thus the vibration in the y direction of the strings 31 to 36 is detected by the vibration sensor for a musical instrument 10. The vibration sensor for a musical instrument may be fixed so that the shield film 16 may be located close to the bottom surfaces of the saddle bodies 23 and 24.

The vibration sensor for a musical instrument 10 can be small in size and thus may be fixed to the saddle bodies 23 and 24 so as to face the first electrode film 12 and the second electrode film 14 each other in the x direction to detect the vibration in the x direction, or may be fixed to the saddle bodies 23 and 24 so as to face the first electrode film 12 and the second electrode film 14 each other in the z direction to detect the vibration in the z direction. In any direction other than the x, y, and z directions, the first electrode film 12 and the second electrode film 14 may be made to face each other to detect the vibration in any direction. The vibration sensor for a musical instrument 10 may be divided into multiple parts, and may be fixed to the saddle bodies 23 and 24. That is, smaller vibration sensors for a musical instrument corresponding to the number of strings 31 to 36 may be built in the saddle bodies 23 and 24 to detect the vibrations of different strings by the use of different vibration sensors for a musical instrument 10.

Figure 5:
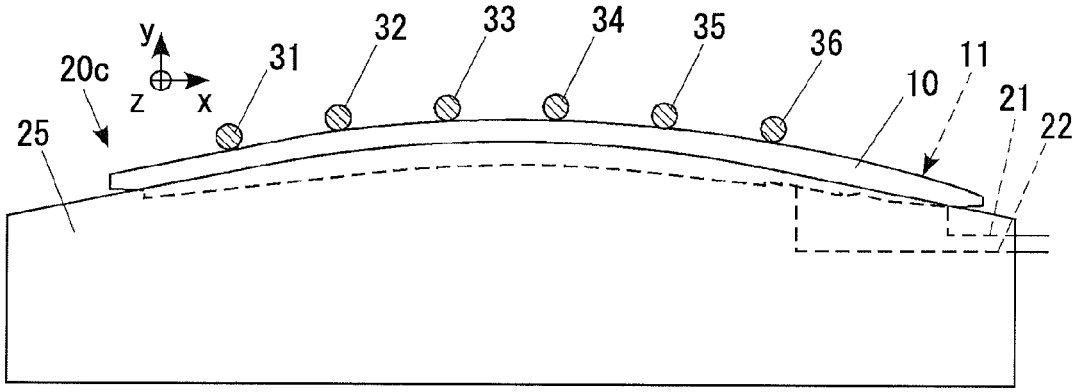
FIG. 5 is a side view illustrating a pickup saddle of a third embodiment according to the present invention.

When the substrate 11 is formed of a material having high toughness (bonding strength), the vibration sensor for a musical instrument 10 can be fixed to the saddle bodies 24 and 25 in a state where the vibration sensor is curved, as shown in FIGS. 4 and 5. For example, as shown in FIG. 4, the distances d1 to d6 from the strings 31 to 36 to the vibration sensor for a musical instrument 10 may be independently adjusted by curving the vibration sensor for a musical instrument 10. The period of time and the magnitude of attenuation until the vibrations of the strings 31 to 36 propagate to the vibration sensor for a musical instrument 10 depend on the distances d1 to d6 from the strings 31 to 36 to the vibration sensor for a musical instrument 10. By reducing the distances between the vibration sensor for a musical instrument 10 and the strings 31 to 36, it is possible to raise the response speed of the vibration sensor for a musical instrument 10 and to enhance the sensitivity. Therefore, when the distances d1 to d6 from the strings 31 to 36 to the vibration sensor for a musical instrument 10 are independently adjusted by curving the vibration sensor for a musical instrument 10, it is possible to the response characteristics and the sensitivity of the vibration sensor for a musical instrument 10 for each string.

As shown in FIG. 5, in the pickup saddle 20*c* of the third embodiment, the vibration sensor for a musical instrument 10 is fixed in a state where it is curved along the top surface of the saddle body 25, so that the vibration sensor for a musical instrument 10 is brought into direct contact with the strings 31 to 36. In this case, as shown in FIG. 5, it is preferable that the vibration sensor for a musical instrument 10 be fixed to the top surface of the saddle body 25 with a posture in which the substrate 11 comes in contact with the strings 31 to 36. As described above, by reducing the distances between the vibration sensor for a musical instrument 10 and the strings 31 to 36, it is possible to raise the response speed of the vibration sensor for a musical instrument 10 and to enhance the sensitivity. Accordingly, when the vibration sensor for a musical instrument 10 is fixed to the top surface of the saddle body 25 and the strings 31 to 36 are brought into direct contact with the vibration sensor for a musical instrument 10, it is possible to implement a pickup saddle 20*c* with a high response speed and high sensitivity.

A method of manufacturing the pickup saddle 20*a* of the first embodiment will be described below with reference FIGS. 6A to 6K. FIG. 6B is a cross-sectional view taken along line 6B-6B of FIG. 6A. Similarly, FIGS. 6D, 6F, 6H and 6J are cross-sectional views taken along line 6D-6D of FIG. 6C, line 6F-6F of FIG. 6E, line 6H-6H of FIG. 6G, and line 6J-6J of FIG. 6I, respectively.

Figure 6A:
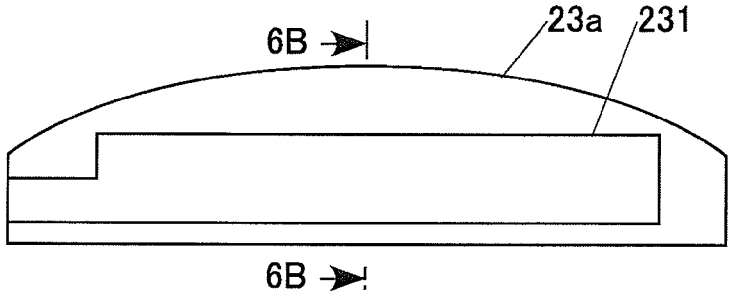
FIGS. 6A, 6C, 6E, 6G, 6I, and 6K are side views illustrating a method of manufacturing the pickup saddle of the first embodiment according to the present invention.
Figure 6B:
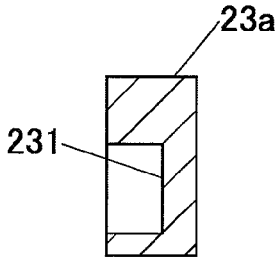
FIGS. 6B, 6D, 6F, 6H, and 6J are cross-sectional views illustrating the method of manufacturing the pickup saddle of the first embodiment according to the present invention.
Figure 6C:
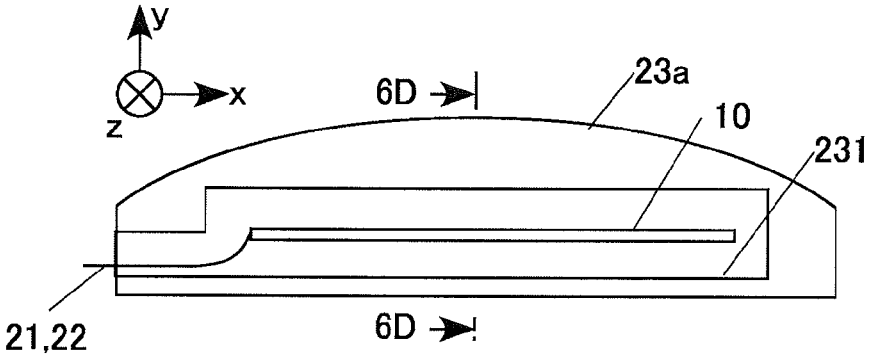
Figure 6D:
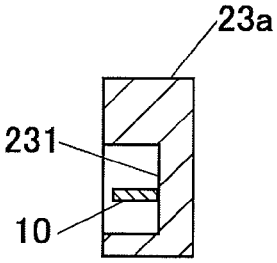
Figure 6E:
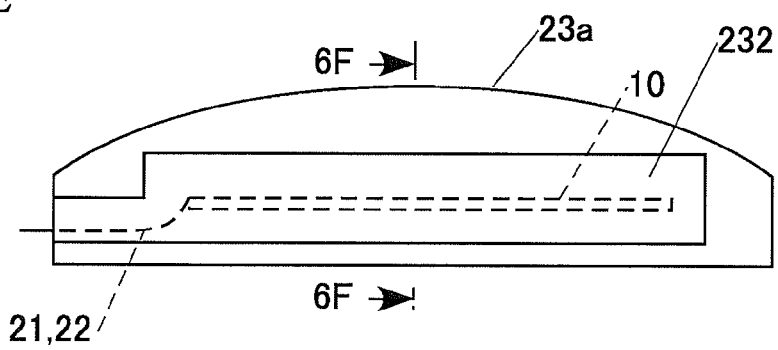
Figure 6F:
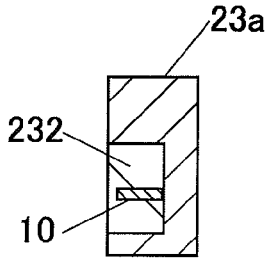

First, as shown in FIGS. 6A and 6B, the sensor receiving section 231 having a concave portion is formed in a side surface of the saddle body 23*a*. The sensor receiving section 231 includes an area for drawing out a conductor line. As shown in FIGS. 6C and 6D, the vibration sensor for a musical instrument 10 is received in the sensor receiving section 231 so as to detect the vibration, for example, in the y direction. The gap between the sensor receiving section 231 formed in the saddle body 23*a* and the vibration sensor for a musical instrument 10 received therein is filled with a resin 232 as a filler, as shown in FIGS. 6E and 6F, whereby the pickup saddle having the vibration sensor for a musical instrument 10 built therein is completed. By setting the color of the resin 232 to the same color as the saddle body 23*a* and finishing the surface of the resin 232 so as to be flush with the side surface of the saddle body 23*a*, the appearance of the pickup saddle is not damaged even when the vibration sensor for a musical instrument 10 is built therein. The sensor receiving section formed in the saddle body may penetrate the saddle body.

Figure 6G:
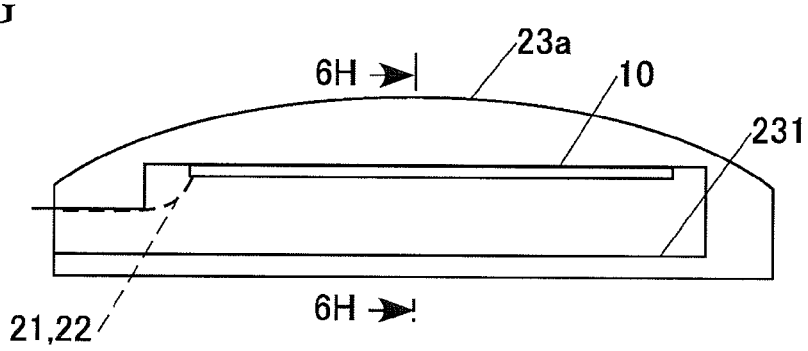
Figure 6H:
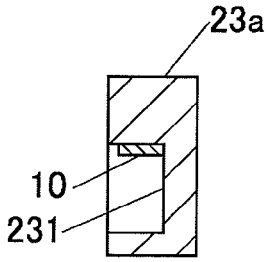
Figure 6I:
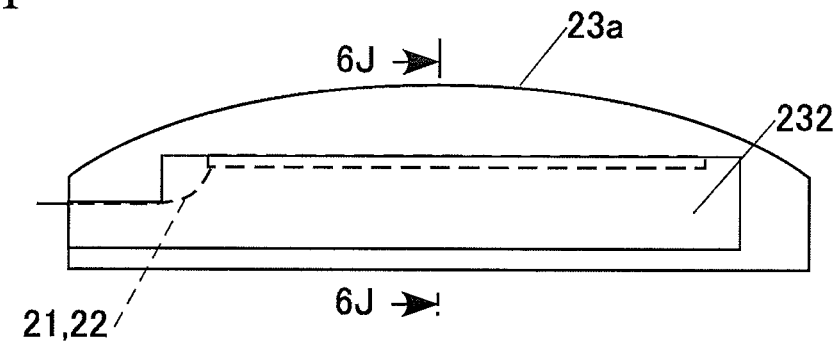
Figure 6J:
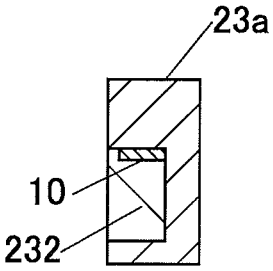

As shown in FIGS. 6G and 6H, the vibration sensor for a musical instrument 10 may be fixed to one surface of the sensor receiving section 231 with an adhesive or the like, and then the gap may be filled with the resin 232 as shown in FIGS. 6I and 6J. In this case, since the vibration sensor for a musical instrument 10 can be securely fixed to the saddle body 23*a*, it is possible to efficiently detect the vibrations of the strings by the use of the vibration sensor for a musical instrument 10. Pores or unevenness may be formed in one surface of the sensor receiving section 231 to which the vibration sensor for a musical instrument 10 is fixed. Since the pores or recesses can hold an unnecessary adhesive or the like, it is possible to easily mount the vibration sensor for a musical instrument 10 on the saddle body 23*a* so as to reduce the minimum gap between the vibration sensor for a musical instrument 10 and the saddle body 23*a*.

Figure 6K:
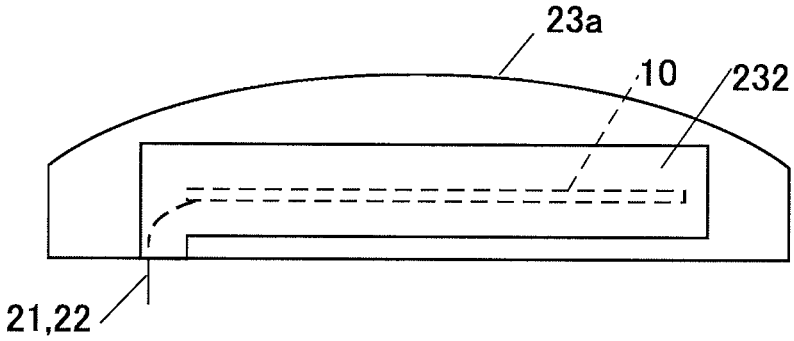

Alternatively, the conductor wires 21 and 22 may be drawn from the bottom surface of the saddle body 23*a* to shade the wires 21 and 22 with the saddle body 23 from view, as shown in FIG. 6K.

Figure 7A:
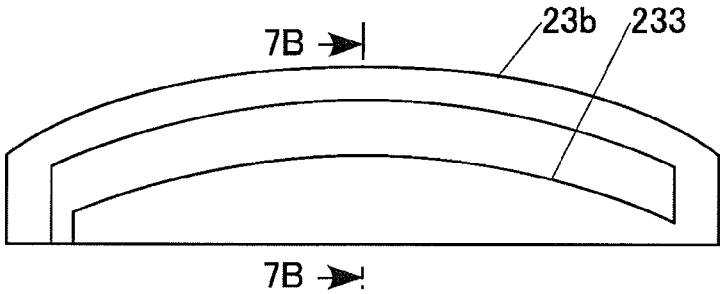
FIGS. 7A, 7C, 7E, 7G, and 7I are side views illustrating a method of manufacturing the pickup saddle of the second embodiment according to the present invention.
Figure 7B:
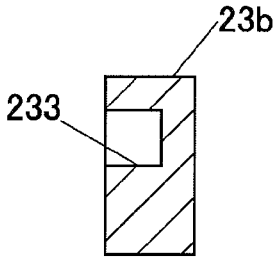
FIGS. 7B, 7D, 7F, 7H, and 7J are cross-sectional views illustrating the method of manufacturing the pickup saddle of the second embodiment according to the present invention.
Figure 7C:
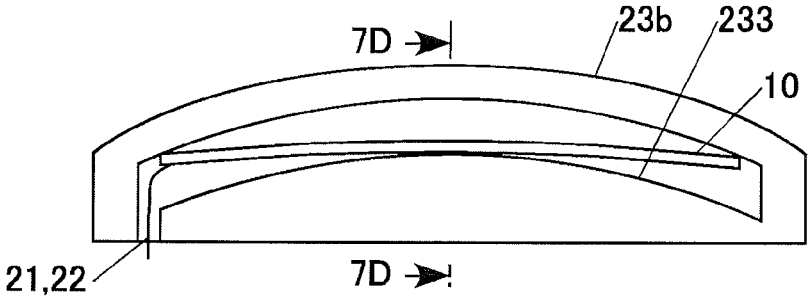
Figure 7D:
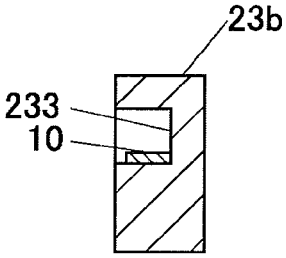
Figure 7E:
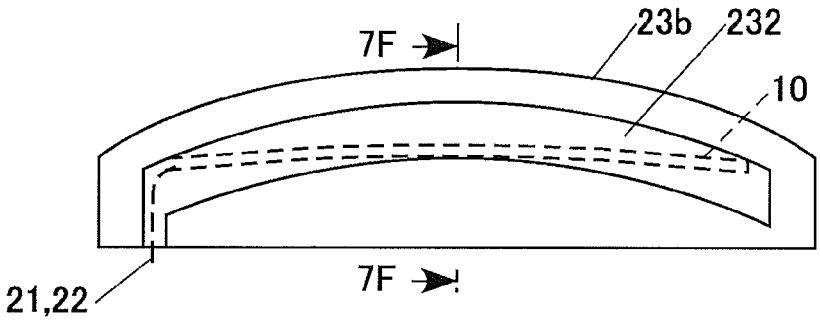
Figure 7F:
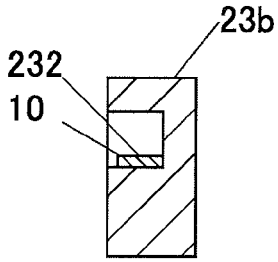
Figure 7G:
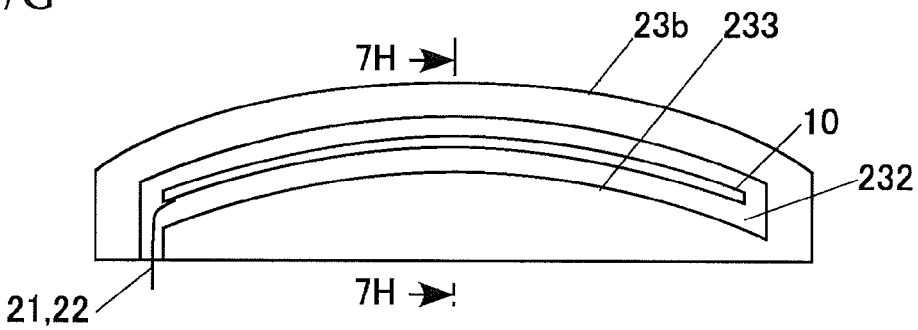
Figure 7H:
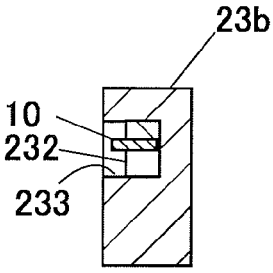
Figure 7I:
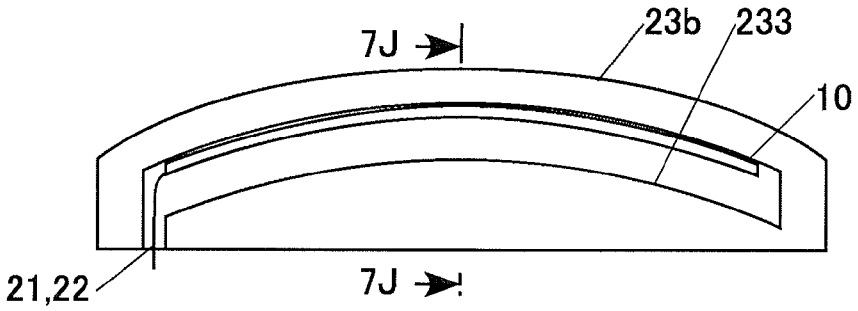
Figure 7J:
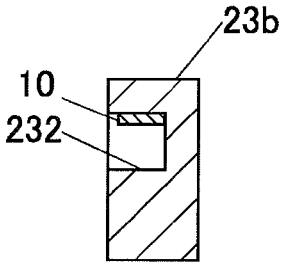

A method of manufacturing the pickup saddle 20*b* of the second embodiment will be described below with reference to FIGS. 7A and 7J. FIG. 7B is a cross-sectional view taken along line 7B-7B of FIG. 7A. Similarly, FIGS. 7D, 7F, 7H and 7J are cross-sectional views taken along line 7D-7D of FIG. 7C, line 7F-7F of FIG. 7E, line 7H-7H of FIG. 7G, and line 7J-7J of FIG. 7I, respectively.

As described above, by curving the vibration sensor for a musical instrument 10, it is possible to adjust the distances from the strings to the vibration sensor for a musical instrument 10. Accordingly, as shown in FIGS. 7A and 7B, the sensor receiving section 233 is formed in a curved shape along the surface of the saddle body 23*b* coming in contact with the strings. Then, as shown in FIGS. 7C and 7D, the vibration sensor for a musical instrument 10 is received in the sensor receiving section 233 in a curved state through the use of the side surface of the sensor receiving section 233. Then, as shown in FIGS. 7E and 7F, the gap of the sensor receiving section 233 is filled with the resin 232. As shown in FIGS. 7G and 7H, in the state where the vibration sensor for a musical instrument 10 is maintained in a curved state and is received in the sensor receiving section 233, the gap of the sensor receiving section 233 may be filled incompletely with the resin 232. After the resin 232 is cured to the extent that the vibration sensor for a musical instrument 10 is maintained in the curved state, the other gap may be filled with an addition resin. As shown in FIGS. 7I and 7J, after the vibration sensor for a musical instrument 10 is fixed to the surface of the sensor receiving section 233 curved along the surface of the saddle body 23*b* coming in contact with the strings, the gap may be filled with the resin 232. The shape of the sensor receiving section is not limited to the shape shown in FIG. 7A, but the a point of inflection such as an S shape or a wavy shape 10 may be mounted thereon even when the shape of the sensor receiving section includes a curved surface having a point of inflection such as an S shape or a wavy shape.

Figure 8A:
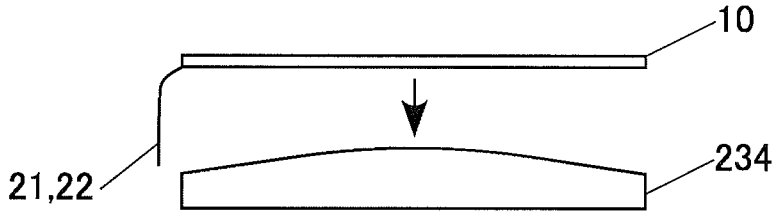
FIGS. 8A, 8B, and 8D are side views illustrating a modification of the method of manufacturing the pickup saddle of the second embodiment according to the present invention.
Figure 8B:
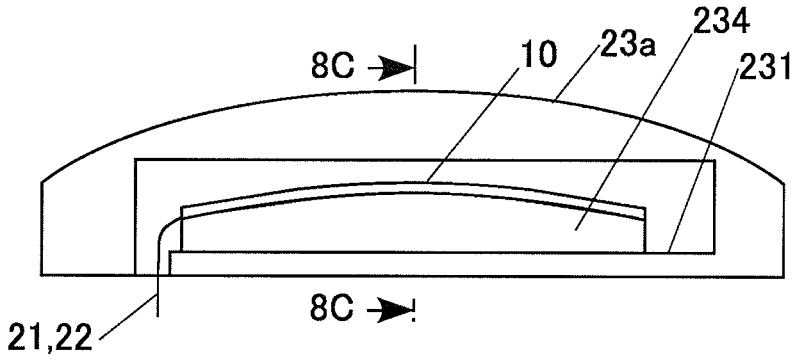
Figure 8C:
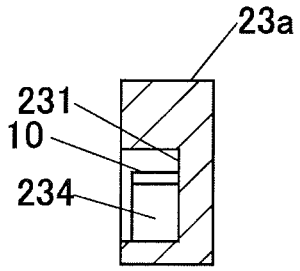
FIGS. 8C and 8E are cross-sectional views illustrating the modification of the method of manufacturing the pickup saddle of the second embodiment according to the present invention.
Figure 8D:
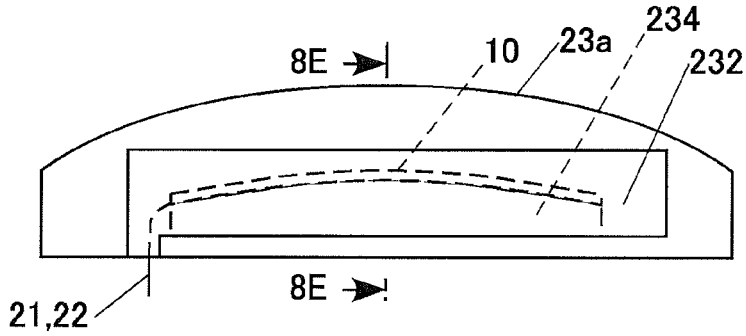
Figure 8E:
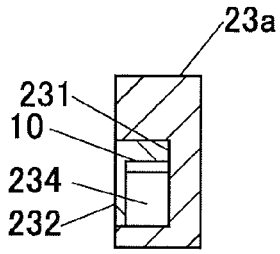

The vibration sensor for a musical instrument 10 may be fixed to a curved surface of a pedestal 234 as shown in FIG. 8A, the vibration sensor for a musical instrument 10 is received in the sensor receiving section 231 along with the pedestal 234 as shown in FIGS. 8B and 8C, and the gap may be filled with the resin 232 as shown in FIGS. 8D and 8E. FIG. 8C is a cross-sectional view taken along line 8C-8C of FIG. 8B, and FIG. 8E is a cross-sectional view taken along line 8E-8E of FIG. 8D.

As shown in FIGS. 7C, 7G and 8B, the conductor wires 21 and 22 are drawn from the bottom surface of the saddle body 23*b* to shade the wires 21 and 22 with the saddle body 23 from view.

The invention can be applied to vibration sensors for a musical instrument or pickup saddles used in other stringed instruments such as violins or cellos. The size of the vibration sensor can be arbitrarily set depending on the size of the pickup saddle or the instrument body.

While the embodiments of the invention are described above with reference to the accompanying drawings, the specific configuration of the invention is not limited to the above-mentioned embodiments, but includes changes in design and the like without departing from the concept of the invention. That is, the technical scope of the invention is not limited to the above-mentioned embodiments, but may be modified in various forms without departing from the concept of the invention described in the appended claims.

What is claimed is:

1. A vibration sensor for a musical instrument, comprising:

a substrate;

a first electrode film on the substrate;

a piezoelectric film on the first electrode film;

a second electrode film on the piezoelectric film;

an insulating film on the second electrode film; and a shield film on the insulating film, the shield film being made of a conductive material, electrically connected to the first electrode film and insulated from the second electrode film by the insulating film, wherein the piezoelectric film includes a sloped end face so that the piezoelectric film has a sectional shape that is widened toward the substrate.

2. The vibration sensor for a musical instrument according to claim 1, wherein at least a part of the end face of the first electrode film is located inward from the sloped end face of the piezoelectric film, and wherein the second electrode film reaches the substrate along the sloped end face of the piezoelectric film.

3. The vibration sensor for a musical instrument according to claim 1, wherein the substrate is formed of ceramic.

4. The vibration sensor for a musical instrument according to claim 1, wherein the substrate is formed of Si or Si compound.

5. A pickup saddle comprising:

a saddle that supports a string; and a vibration sensor for a musical instrument being fixed to the saddle and including a substrate, a first electrode film on the substrate, a piezoelectric film on the first electrode film, a second electrode film on the piezoelectric film, an insulating film on the second electrode film, and a shield film on the insulating film, the shield film being made of a conductive material, electrically connected to the first electrode film and insulated from the second electrode film by the insulating film, wherein the piezoelectric film includes a sloped end face so that the piezoelectric film has a sectional shape that is widened toward the substrate.

6. The pickup saddle according to claim 5, wherein the vibration sensor for a musical instrument is fixed to the saddle in a state where the vibration sensor is curved.

7. The pickup saddle according to claim 5, further comprising:

a sensor receiving section in the saddle and that receives the vibration sensor for a musical instrument; and a filler that fills a region in the sensor receiving section other than the vibration sensor for a musical instrument.

8. The pickup saddle according to claim 7, wherein the vibration sensor for a musical instrument is received in the sensor receiving section in a state where the substrate is curved.

9. The pickup saddle according to claim 7, wherein the vibration sensor for a musical instrument is fixed to any surface of the sensor receiving section.

10. A musical instrument including a pickup saddle comprising:

a saddle that supports a string; and a vibration sensor for a musical instrument being fixed to the saddle and including a substrate, a first electrode film on the substrate, a piezoelectric film on the first electrode film, a second electrode film on the piezoelectric film, an insulating film on the second electrode film, and a shield film on the insulating film, the shield film being made of a conductive material, electrically connected to the first electrode film and insulated from the second electrode film by the insulating film, wherein the piezoelectric film includes a sloped end face so that the piezoelectric film has a sectional shape that is widened toward the substrate.

11. A method of manufacturing a vibration sensor for a musical instrument, comprising:

preparing a substrate;

forming a first electrode film on the substrate by a thin film forming method;

forming a piezoelectric film on the first electrode film by a thin film forming method so as to exclude an end portion of the first electrode film, the piezoelectric film including a sloped end face so that the piezoelectric film has a sectional shape that is widened toward the substrate;

forming a second electrode film on the piezoelectric film by a thin film forming method;

forming an insulating film on the second electrode film by a thin film forming method; and forming a shield film out of a conductive material on the insulating film and the end portion of the first electrode film by a thin film forming method.

12. A method of manufacturing a vibration sensor for a musical instrument, comprising:

forming a vibration sensor for a musical instrument;

forming a hollow sensor receiving section in a pickup saddle body;

receiving the vibration sensor for a musical instrument in the sensor receiving section; and filling the gap of the sensor receiving section having received the vibration sensor for a musical instrument with a resin, wherein the step of forming the vibration sensor for a musical instrument includes the steps of preparing a substrate, forming a first electrode film on the substrate by a thin film forming method, forming a piezoelectric film on the first electrode film by a thin film forming method so as to exclude an end portion of the first electrode film, forming a second electrode film on the piezoelectric film by a thin film forming method, forming an insulating film on the second electrode film by a thin film forming method, and forming a shield film out of a conductive material on the insulating film and the end portion of the first electrode film by a thin film forming method, and wherein the piezoelectric film includes a sloped end face so that the piezoelectric film has a sectional shape that is widened toward the substrate.

13. The method of manufacturing a pickup saddle according to claim 12, wherein in the step of receiving the vibration sensor for a musical instrument in the sensor receiving section, the vibration sensor for a musical instrument is curved along the shape of the top surface of the saddle body and is then received in the sensor receiving section.

* * * * *